US005592739A

United States Patent [19]

Ferrill et al.

[11] Patent Number: 5,592,739

[45] Date of Patent: Jan. 14, 1997

[54] BONDING DISCRETE WIRES TO FORM UNITARY RIBBON CABLE

[75] Inventors: Jess B. Ferrill, Madison; Kevin H. Snead, Greensboro, both of N.C.

[73] Assignee: The Whitaker Corporation, Wilmington, Del.

[21] Appl. No.: 334,172

[22] Filed: Oct. 31, 1994

[51] Int. Cl.[6] ..... H01R 43/00

[52] U.S. Cl. ..... 29/872; 29/868; 156/273.9; 156/290

[58] Field of Search ..... 29/868, 872; 174/113 R, 174/117 R, 117 F; 439/374, 676, 719; 156/51, 52, 166, 196, 199, 290, 292, 272.2, 273.9

[56] References Cited

U.S. PATENT DOCUMENTS

| | | | |
|---|---|---|---|
| 3,226,278 | 12/1965 | Schofield et al. . | |
| 4,356,345 | 10/1982 | Gonia | 174/117 F |
| 4,381,208 | 4/1983 | Baverstock | 29/872 X |
| 4,486,253 | 12/1984 | Gonia | 156/51 |
| 4,577,920 | 3/1986 | Coldren et al. | 339/143 R |
| 4,601,530 | 7/1986 | Coldren et al. | 339/103 M |
| 4,713,023 | 12/1987 | Bixler et al. | 439/393 |
| 4,767,355 | 8/1988 | Phillipson etal. | 439/425 |
| 4,767,891 | 8/1988 | Biegon et al. | 174/117 F X |
| 4,978,813 | 12/1990 | Clayton eet al. | 174/17 F |
| 5,005,611 | 4/1991 | Hecker | 29/872 |
| 5,147,215 | 9/1992 | Pritulsky | 439/344 |
| 5,342,991 | 8/1994 | Xu et al. | 174/117 F X |

FOREIGN PATENT DOCUMENTS 2249222 4/1992 United Kingdom .

*Primary Examiner*—S. Thomas Hughes

[57] ABSTRACT

This invention is directed to a method and to a preferred fixture, for aligning and bonding a plurality of discrete insulation jacketed conductors to facilitate handling and insertion of the conductors into an electrical connector housing to be electrically terminated therein. The method comprises the steps of selecting plural discrete insulation jacketed conductors arranged in at least two different planes, arranging and aligning the ends of plural conductors in side-by-side fashion in a common plane on a fixture, and bonding the insulation jackets of adjacent wire ends to form a unitary ribbon type cable for ease of handling and termination. A preferred bonding procedure is by the application of localized heat to the wire ends to effect a melting and bonding of the insulation jackets.

8 Claims, 4 Drawing Sheets

BONDING DISCRETE WIRES TO FORM UNITARY RIBBON CABLE

BACKGROUND OF THE INVENTION

This invention is directed to a method of bonding the entry ends of a plurality of discrete wires to form a unitary ribbon cable for insertion into and termination by an electrical connector, such as a modular plug. While the invention has diverse application for the preparation of wires to be terminated within a connector, it has particular utility with the loading of modular plugs which often must be terminated in the field by technicians, or in small factory operations manually. A first approach introduced several years ago was the use of a load bar insert, or wire organizer, where the discrete wires were first loaded into such load bar insert to align and position the wires for eventual entry into the connector. However, problems still persisted with the use of such inserts, as free ends of the wires still had to be directed to an assigned passageway in the connector, and stubbing of the end could result.

While the application of this invention is broad, for convenience, the further description will be directed to the field of modular plugs, a product well known in the art, and the applicability of the invention hereof as it relates to the loading of a modular plug. Modular plugs, a relatively inexpensive electrical connector, are used extensively in telephonic and other data communication systems. Frequently such plugs must be terminated in the field by technicians, or in a factory by assemblers fabricating patch cords. Typically the cable to be terminated in the plug is a bundle of four twisted pair, insulated, multi-colored wires (eight in total), within a cable jacket or wrap of an insulating sheath. The bundle may optionally include a surrounding shield or a drain wire for use in a shielded plug. In any case, to prepare the cable for eventual termination in the plug, the cable jacket is peeled back to expose the various insulated pairs. Thereafter, with the several insulated wires exposed, the wires are untwisted and arranged in the desired order, generally in a side-by-side fashion. The wires are then individually inserted into the connector housing and terminated by an insulation piercing blade, a termination procedure known in the art. Recognizing these cumbersome procedures, load bar inserts were developed to facilitate the loading process. A typical loading bar insert is illustrated in U.S. Pat. No. 4,713,023. The invention thereof includes a wire positioning means for holding insulated conductors in an array so that the ends thereof are presented in alignment below terminal receiving cavities when the wire loaded positioning means is in the housing. The positioning means includes cam means formed thereon and adapted to engage a housing strain relief section when it is moved downwardly, whereby the positioning means is moved forwardly in the housing to fully seat the positioning means therein and position the free ends of the insulated conductors below the terminals.

In UK Patent Application NO. 2 249 222A, assigned to the assignee hereof, there is taught an electrical connector and insert therefor, where the invention relates to a plastic insert for such connector and has a row of wire guiding mouths each for guiding an individual wire into a passageway as the cable is inserted into the connector. The cable has at least one wire less than the number of the passageways and the insert has at least one solid blanking-off portion for blanking off the single or plural unused passageways. The wire guiding mouths of the insert are defined by at least one longitudinal opening having scalloped longitudinal edges.

U.S. Pat. No. 4,601,530, assigned to the assignee hereof, teaches a preloaded wire organizer for a modular type plug. Specifically, the patent teaches the process of preloading wires into a wire holder which locates the leading ends of the wires at the same pitch as passageways in the connector housing. The wire holder, supported by the wires, is then inserted into and along a mouth of the housing until it abuts a tapered throat at the entrance to the passageways. Further advance of the bundle feeds the discrete wires through the wire holder into the respective passageways guided by the throat, while the wire holder remains adjacent the tapered throat.

In a recent development that utilizes a load bar insert for use with a modular plug, while offering improved performance at Category 5 levels, a performance level known in the art, was introduced by Stewart Connector Systems, Inc. of Glen Rock, Pa. They introduced a Category 5 performing modular plug utilizing a sliding wire management bar, where such bar contains two rows, each with four through holes, to receive the standard eight wires of a cable. To use the management bar, the user is advised to arrange the wires in two equal sets, and cut each set of four at a 45° angle such that no two wires are of the same length. With the prepared wires, the wires are individually fed into the holes of the wire organizer, in sliding engagement therewith, then trimmed to the same length. For the loading step, the wire organizer is first pushed to the end of the trimmed wires, then inserted into the connector housing. In the fashion of U.S. Pat. No. 4,601,530, when the wire organizer can no longer move forward, the wires are pushed beyond the wire organizer into a position to be individually terminated, as known in the art. While claiming to provide Category 5 performance, the assembly and termination of the modular plug is very labor intensive.

In a companion patent application, filed concurrently with this application by one of the inventors hereof, where such companion application was assigned U.S. Ser. No. (Attorney Docket 16012), an improved load bar insert is disclosed. The invention thereof, where the application is incorporated herein in its entirety, relates to an electrical connector, preferably a modular plug. A preferred embodiment of the invention of said companion application comprises a dielectric housing having a conductor receiving end, a conductor terminating end, a passageway communicating internally between the respective ends, and a spacing insert in the passageway to receive a plurality of conductors and to position same in a manner to achieve Category 5 performance levels in the modular plug. The insert is characterized by having an upper surface and a lower surface to receive or position selected pairs of the conductors. Within the limits of the housing, the insert maximizes the separation of the selected pairs and arranges them in plural planes before being realigned into a common plane for termination at the conductor terminating end. A first embodiment includes grooves in the upper and lower surfaces of the insert, while a second embodiment is directed to a rod like member, such as may be made of an elastomer, styrofoam, or plastic tube. A feature of this companion invention is the provision of separating the wires into plural planes, then bringing them together for loading into the modular plug. By incorporating the method of this invention, improved performance levels are ensured in a timely and cost efficient manner.

The procedure by which this invention supports the performance and loading of the modular plug of the companion application, and its ability to generally improve the speed in which modular plugs may be factory terminated, will become apparent in the description which follows, particularly when read in conjunction with the accompanying drawings.

SUMMARY OF THE INVENTION

This invention is directed to the field of electrical connectors, such as a modular plug, where a plurality of insulation jacketed wires are inserted into and terminated within the plug, where one such termination procedure is by insulation piercing. The method of this invention is particularly directed to a procedure for aligning and bonding, such as by heat, adhesive or tape, a plurality of discrete insulation jacketed wires to facilitate the handling and insertion of the wires into a modular plug housing, for example, where they are terminated. The steps in bonding by heat comprise aligning the plural wires in side-by-side fashion on a first fixture, where the fixture includes a plurality of heating elements, with each heating element arranged to contact the insulation jackets of an adjacent pair of the wires. Thereafter, aligning a second fixture of comparable design and function in sandwich fashion to the opposite sides of the insulation jacketed wires, and applying electrical current to the heating elements to effect a localized melting and bonding of the insulation jackets of adjacent wires to one another. By this procedure a unitary ribbon type cable is formed which facilitates its handling and termination.

DETAILED DESCRIPTION OF PREFERRED EMBODIMENTS

This invention relates to a procedure for bonding plural, discrete, insulated wires to form a unitary ribbon cable, and to the product thereof. More particularly, the invention is directed to a cost effective method for manual factory wiring of a modular plug, for example.

Figure 1:
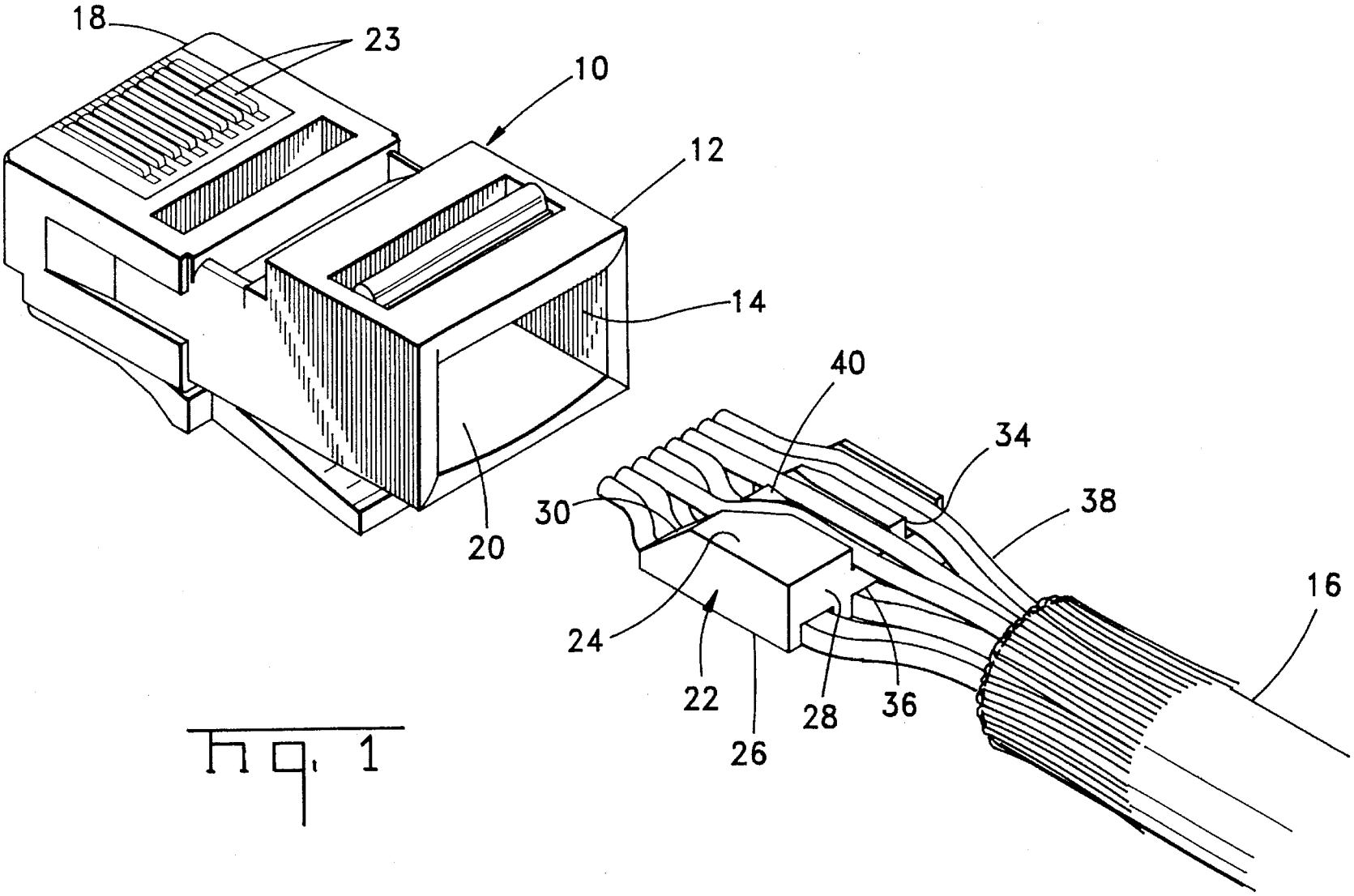
FIG. 1 is an exploded perspective view of an electrical connector, such as a modular plug, for example, in which the procedure of the present invention has been practiced to support the loading bar invention of the co-pending application.

FIG. 1 illustrates a prime example of how the method of this invention can simplify the loading and termination of a modular plug. A typical electrical connector 10, as shown in FIG. 1, comprises an insulating housing 12 formed with an open end 14 for receiving a multi-wire electrical cable 16, a terminating end 18 communicating with a row of cable wire receiving passageways. The passageways further communicate with an internal cavity 20 opening into end 14. By way of further understanding, the multi-wire electrical cable 16 is characterized as twisted pair cable, where preferably selected pairs of wires are twisted together. That is, a typical cable for an 8-position modular plug will reveal four twisted pairs of insulated wires. By way of further example, under specification TIA/EIA-568A, a preferred pairing arrangement of conductors or wires for the modular plug terminal numbers is as follows: 1–2, 3–6, 4–5, and 7–8.

As noted previously, this invention has utility in the loading of fine wires to electrical connectors, with or without the assistance of a loading bar insert or wire organizer. Nevertheless, the preferred approach lies in the use of this invention with a loading bar insert 22, as more fully taught in the companion application, and illustrated in FIGS. 1 and 7. While the companion application discloses some alternative embodiments for the insert, ranging from a relatively solid body to a member with a low dielectric constant, hollow cylinder or shape, for example, the further discussion will be directed to the solid embodiment of FIGS. 1 and 7. This alternate embodiment of an insert, molded or formed of a rod or shaped body, includes upper and lower surfaces 24, 26, respectively, a back 28, and a tapered or divergent forward surface 30 directed to the cable receiving passageway 32 underlying the conductor terminating blades or terminals 23 see FIG. 7. Along the respective upper and lower surfaces 24, 26, are pairs of slots or grooves 34, 36, respectively, into which selected pairs of wires 38 are received. To carry on with the pairing arrangement above, pairs 3–6 and 7–8 are seated within upper slots 34, while the remaining two pairs are seated within lower slots 36. Note further that the upper slot containing pair 3–6 includes an end divider 40, to separate and align the wires into their numerically assigned position for termination.

Figure 2:
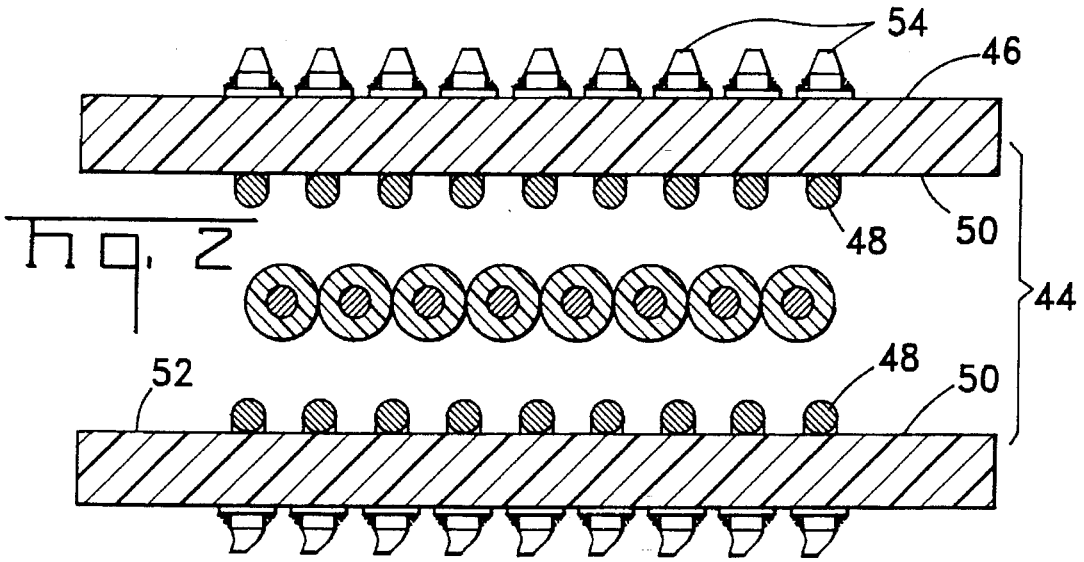
FIGS. 2 to 4 are transverse sectional views illustrating the sequence for bonding discrete wires to form a uniform ribbon cable according to this invention.
Figure 3:
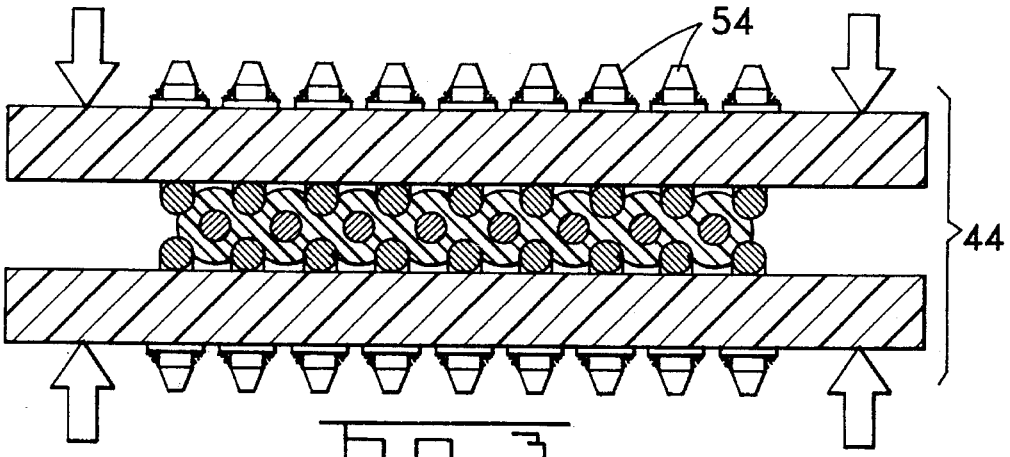
Figure 4:
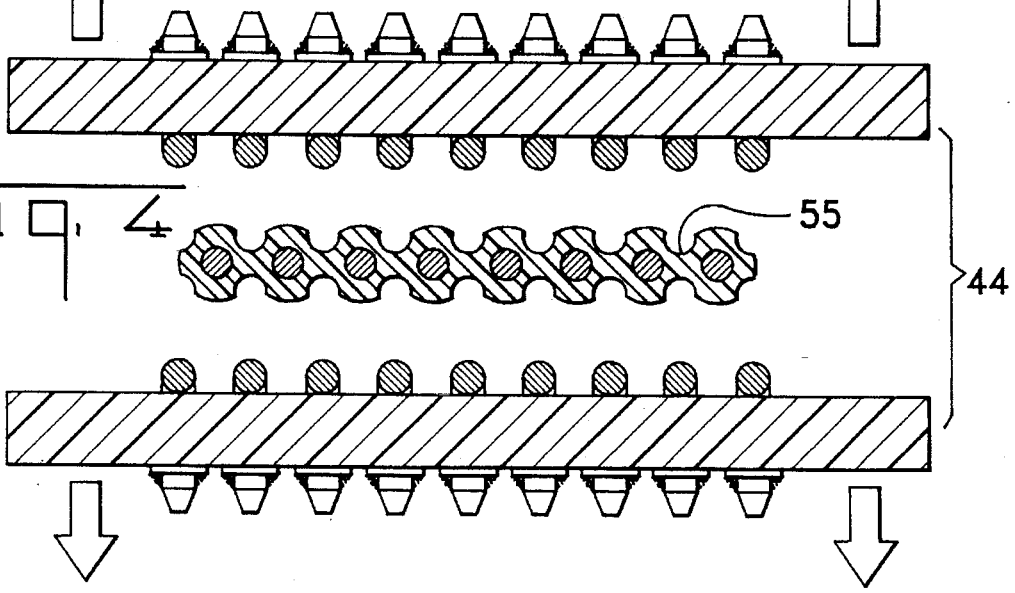
Figure 5:
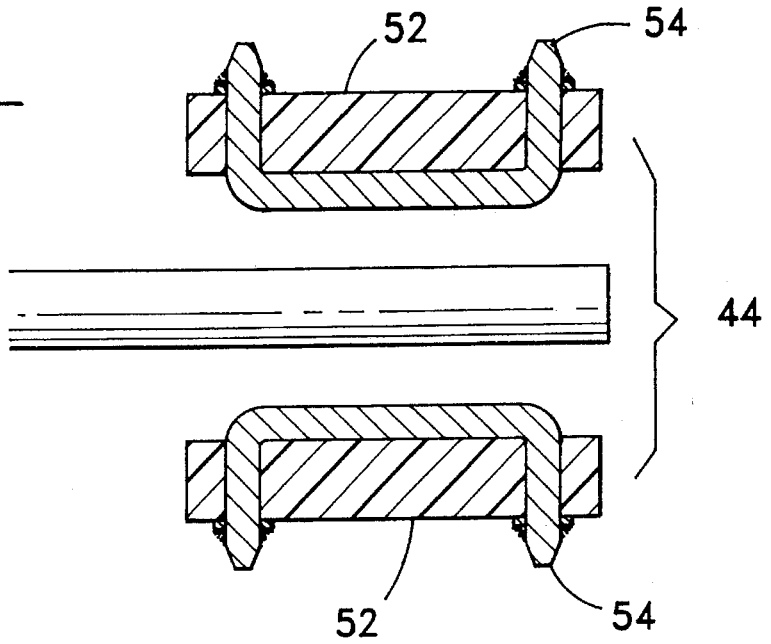
FIGS. 5 and 6 are lateral sectional views corresponding to the sequences illustrated in FIGS. 2 and 3, respectively.
Figure 6:
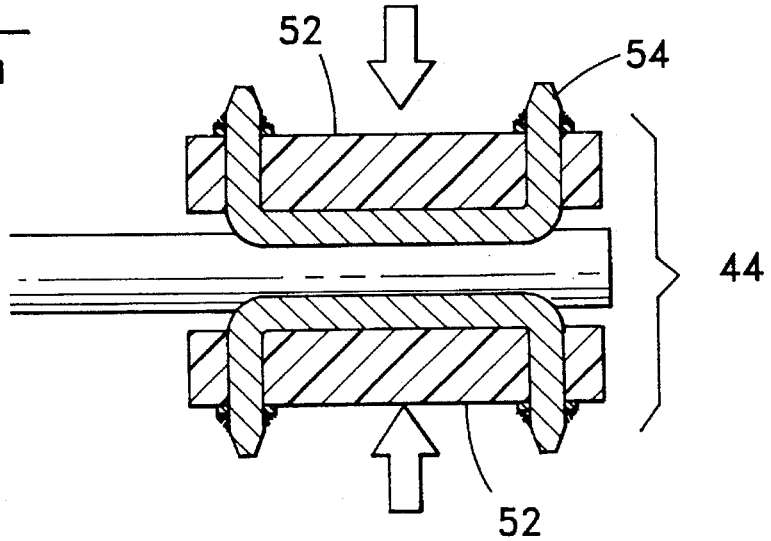

Once the selected pairs are positioned within the insert, or the insert is omitted, the discrete, insulated wires 1 to 8 are positioned between a sandwich like bench fixture 44 illustrated in FIGS. 2 to 6, a preferred practice in bonding the discrete wires. In any case, the pair of fixtures may each comprise a planar body 46 having plural, parallel resistance heating elements 48 arranged along the mating surfaces 50. As best seen in FIGS. 5 and 6, the opposite surface 52 includes means 54 for supplying electric current to the heating elements 48 to effect heating thereof. The heating elements 48 are positioned to lie between adjacent side-by-side wires, and to the outside thereof, see FIG. 3. In the illustrations of FIGS. 2 to 4, if the number of wires is "n", the number of heating elements is "n+1". With the respective fixtures positioned in a compressive relationship to the discrete wires, note the direction arrows of FIG. 3, electrical current may be applied to the heating elements 48 by means 54 to effect melting and bonding of the insulated wires into a unitary ribbon cable at the end thereof. That is, the respective fixtures 44 are brought together to trap and locate the discrete wires exactly on the preferred 0.040" centerlines, where the heating elements 48, such as nichrome heating wires, are also spaced on 0.040" distances. By this arrangement, including the outermost heating elements, the heating elements act as miniature "V" blocks. With the fixtures separated, note the direction arrows of FIG. 4, it will be seen that the wires are bonded, and that a scalloped profile 55 is revealed. Thereafter, the bonded wires are trimmed laterally through the scalloped profile to present a unitary member for insertion and termination within the modular plug. This profile offers a further advantage to the insertion and termination procedure, as hereinafter explained. Another advantage in the use of this type of fixture is the rather quick cool down of the system which allows for a rapid turnaround in repeating the operation with a new and different set of wires.

Figure 8:
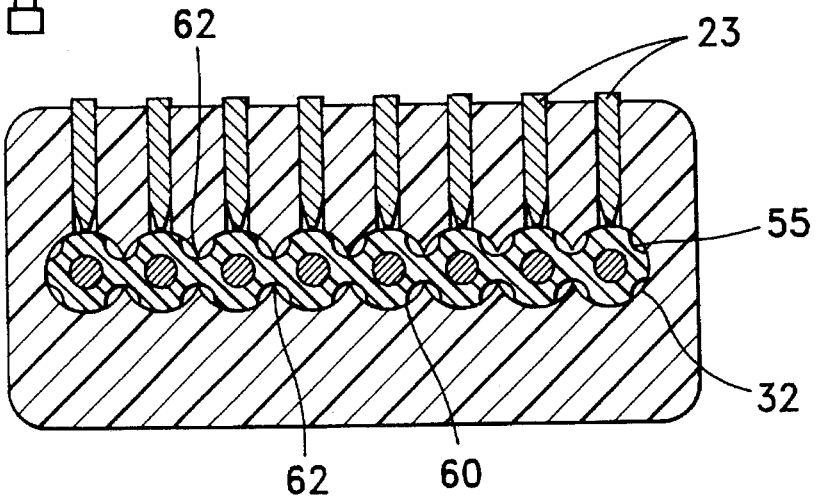
FIG. 8 is a sectional view taken through line 8—8 of FIG. 7.
Figure 7:
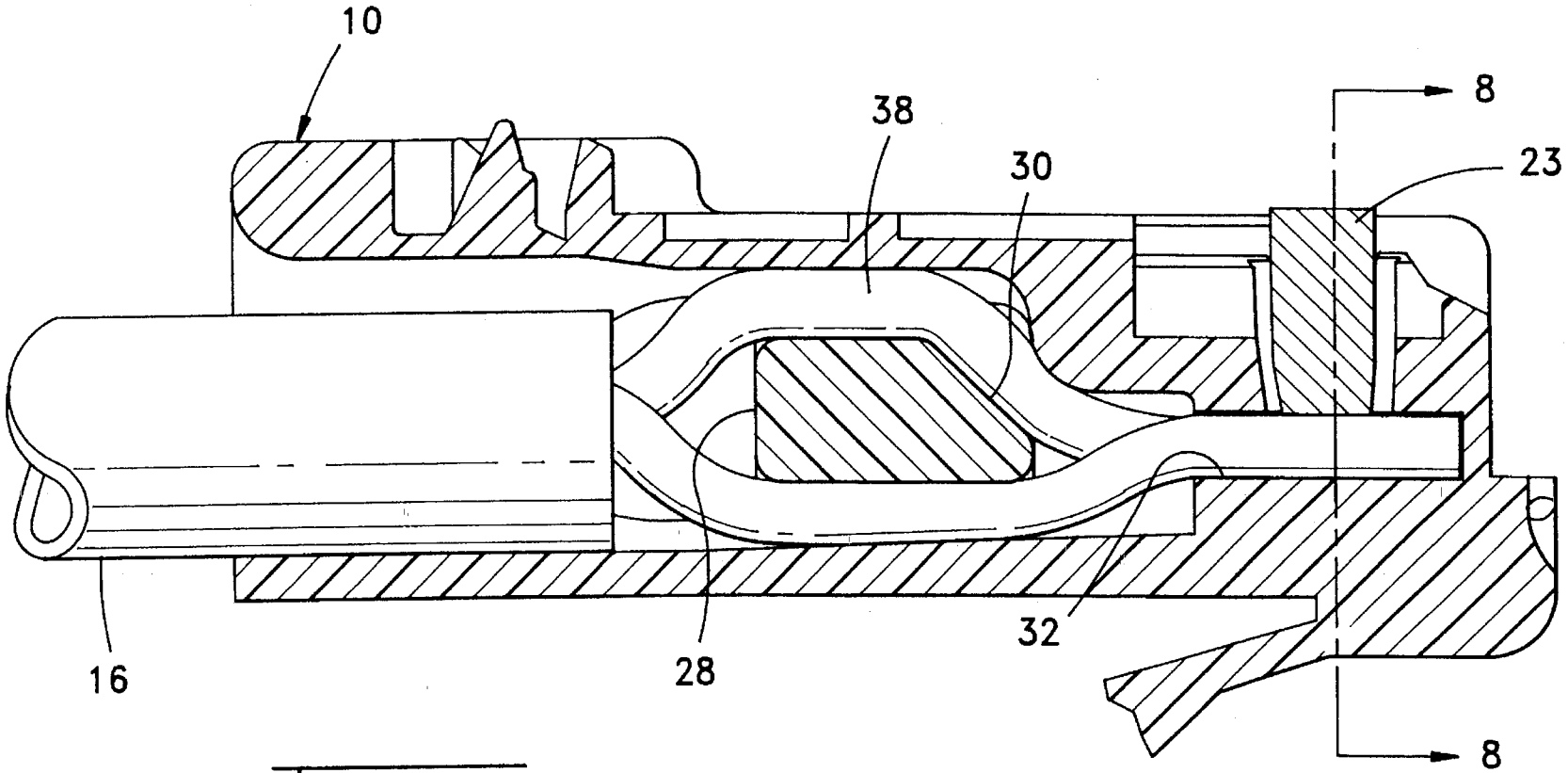
FIG. 7 is a lateral sectional view of the assembled modular plug illustrated in FIG. 1.

FIGS. 7 and 8 illustrate an inserted and preterminated unitary member in a modular plug, where the bonded wires are positioned under the plural terminating blades 23. The passageways 32 into which the bonded wires are received are typically a series of circular communicating sections, where the upper and lower surfaces are scalloped 60, and the sections are separated by two spaced apart opposing ribs 62. With a conventional discrete wire insertion, where the wire is not precisely aligned with the passageway, stubbing can occur. However, with the present invention, where the bonded web between adjacent wires has been modified by the newly impressed profile 55, stubbing problems are greatly minimized. Also, by reshaping or changing the wire profile, it is now possible to use larger diameter wires than heretofore possible. That is, the molded impressions from the scalloped profile 55 create clearances which ease the insertion process and even allow the use of wires exceeding 0.040" diameter, for example.

In accordance with a preferred procedure for practicing this invention, a fixture was prepared using a printed circuit board with nine SST wire loops arranged on 0.040" centerlines, the same spacing as the insulated wires, in parallel fashion. With a pair of such fixtures arranged in sandwich fashion to eight insulated wires, a current of 7 to 10 amps at from 5 to 2 seconds was applied to the SST wire loops to effecting bonding of the insulated wires. After trimming, the bonded wires were readily inserted into a modular plug.

Alternate procedures are available to effect bonding of the wire ends. For example, while the wires are positioned in side-by-side fashion in a suitable fixture, an adhesive or tape may be applied to such ends to present a unitary ribbon cable at least at the end thereof. However, these alternate approaches do not offer the advantage of reshaping the wire ends as will be found in the heat bonding procedure.

We claim:

1. A method of aligning and bonding a plurality of discrete insulation jacketed conductors to facilitate handling and insertion of said conductors into an electrical connector housing to be electrically terminated therein, said method comprising the steps of:

(a) selecting plural discrete insulation jacketed conductors arranged in at least two different planes, (b) arranging and aligning the ends of said plural conductors in side-by-side fashion in a common plane, and (c) bonding the insulation jackets of adjacent said ends through the application of heat to form a unitary ribbon type cable, wherein said heat is derived from heating elements, the number of said conductors is "n", and the number of said heating elements is at least "n+1".

2. The method according to claim 1 wherein the heating elements are arranged with a center-to-center spacing which is essentially the same as the center-to-center spacing of said conductors.

3. The method according to claim 1, wherein the heating elements are arranged in two rows on respective opposite sides of the plane of the conductors.

4. The method according to claim 1, wherein the heating elements are arranged to contact the insulation jackets of respective adjacent pairs of said conductors.

5. A method of aligning and bonding a plurality of discrete insulation jacketed conductors to facilitate handling and insertion of said conductors into an electrical connector housing to be electrically terminated therein said method comprising the steps of:

(a) aligning said plural conductors in side-by-side fashion on a first fixture, where said fixture includes a plurality of heating elements arranged to contact the insulation jackets of respective adjacent pairs of said conductors, (b) aligning a second fixture including a further plurality of heating elements in mutually opposed relationship to the first fixture on an opposite side of said insulation jacketed conductors, and (c) applying electrical current to said heating elements of said first and second fixtures to effect a localized melting and bonding together of the insulation jackets of the conductors in each said pair, thereby forming a ribbon type cable for ease of handling and termination.

6. The method according to claim 5, further comprising the step of inserting said discrete insulation jacketed conductors into and through a dielectric member prior to said aligning in said side-by-side fashion.

7. The method according to claim 5, futher comprising the step of arranging said discrete insulation jacketed conductors along one surface of a dielectric member prior to said aligning in said side-by-side fashion.

8. The method according to claim 5, further comprising the steps of arranging some of said discrete insulation jacketed conductors along a first surface of a dielectric member, and arranging the remaining said discrete insulation jacketed conductors along a second surface of said dielectric member, prior to said aligning in said side-by-side fashion.

* * * * *